US005478170A

United States Patent [19]

Hanamoto et al.

[11] Patent Number: 5,478,170

[45] Date of Patent: Dec. 26, 1995

[54] CONTROLLING APPARATUS FOR EXCAVATOR

[75] Inventors: Tadayuki Hanamoto; Yutaka Kato; Norio Takahashi, all of Hiratsuka, Japan

[73] Assignee: Kabushiki Kaisha Komatsu Seisakusho, Japan

[21] Appl. No.: 193,172

[22] PCT Filed: Jun. 22, 1993

[86] PCT No.: PCT/JP93/00838

§ 371 Date: Feb. 10, 1994

§ 102(e) Date: Feb. 10, 1994

[87] PCT Pub. No.: WO94/00673

PCT Pub. Date: Jan. 6, 1994

[30] Foreign Application Priority Data

Jun. 22, 1992 [JP] Japan ..... 4-163045

[51] Int. Cl.[6] ..... E21D 9/00

[52] U.S. Cl. ..... 405/143; 299/1.3; 405/138; 405/184

[58] Field of Search ..... 405/138, 140, 405/141, 143; 299/1.3, 1.4, 1.5, 1.8; 175/24, 25, 20

[56] References Cited

U.S. PATENT DOCUMENTS

| | | | |
|---|---|---|---|
| 4,571,122 | 2/1986 | Yamamoto et al. | 405/143 X |
| 4,576,515 | 3/1986 | Morimoto et al. | 405/184 |
| 4,655,493 | 4/1987 | Sumi | 405/143 X |
| 4,732,427 | 3/1988 | Lovat | 299/1.3 X |
| 5,186,579 | 2/1993 | Hanamoto et al. | 299/1.4 X |
| 5,236,284 | 8/1993 | Ilomäki | 405/143 |
| 5,295,734 | 3/1994 | Ilomäki | 405/143 X |

FOREIGN PATENT DOCUMENTS

| | | |
|---|---|---|
| 1-235793 | 9/1989 | Japan . |
| 1263385 | 10/1989 | Japan . |
| 4-92095 | 3/1992 | Japan . |
| 1147961 | 4/1969 | United Kingdom . |
| 1182666 | 3/1970 | United Kingdom . |

*Primary Examiner*—Dennis L. Taylor
*Attorney, Agent, or Firm*—Welsh & Katz, Ltd.

[57] ABSTRACT

An object of this invention is to improve precision in the operation, operating efficiency, and reliability of an excavator. A soil condition at a place where an excavator (1) is advanced is inputted, and a reference number of revolutions of a cutter (9) and a reference advancing speed of the excavator (1) are set in correspondence with the inputted soil condition. Meanwhile, a load on each actuator (17, 18) is detected. The actuator (18) for rotating the cutter is controlled so as to allow the set reference number of revolutions to be obtained for the cutter (9). In a case where the load on each of the actuators (17, 18) is within a predetermined range, the actuator (17) for advancing is controlled so as to allow the set reference advancing speed to be obtained for the excavator (1). However, in a case where it is detected that the load on either of the actuators (17, 18) is outside the predetermined range, the actuator (17) for advancing is controlled in such a manner as to decrease or increase the advancing speed more than the reference advancing speed.

8 Claims, 12 Drawing Sheets

CONTROLLING APPARATUS FOR EXCAVATOR

TECHNICAL FIELD

The present invention relates to an apparatus for controlling an excavator such as a small-bore-pipe excavator (trade name: Iron Mole) for burying water pipes, gas pipes or the like.

BACKGROUND ART

In the field of underground excavators for performing tunnel excavation to bury underground water pipes, gas pipes or the like, various controlling apparatuses have been developed to automatically advance the excavation work in accordance with a planned line of execution. As one of controlling apparatuses of this type, one disclosed in Japanese Patent Application No. 332891/1991 is known, wherein, in an auger-type excavator of a single-process construction method having actuators for direction correction, a soil condition is inputted in advance, and the actuators are controlled by means of fuzzy inference based on the inputted value and measured values of a positional offset, an offset angle, thrust, and the like of the excavator.

However, the type of soil where the excavator is advanced is not actually fixed and consecutively changes as the excavator is advanced. For this reason, if the actuators are controlled primarily on the basis of the inputted soil condition the precision of advancing deteriorates, and there are cases where advancing itself becomes impossible. Accordingly, it is desired to develop an apparatus capable of coping with the soil condition which constantly changes, by ascertaining the consecutively changing soil condition by using the inputted soil condition strictly as an initial value, and by controlling the actuators on the basis of the ascertained soil condition. A first aspect of the present invention has this as an object.

In addition, when the excavator is automatically operated, in light of improvement of the reliability of the apparatus, it is required to be able to cope speedily with a failure or the like by conducting a self-diagnostic check of the failure or the like of each portion of the system. In the conventional practice, however, the situation has been merely such that start-up inspection prior to the operation is conducted at best. Yet, the more complicated the system of the excavator becomes, the more the failure or the like occurs in each stage of operation including a stage prior to a start-up, and the details of the failure or the like differ depending on each stage of operation. An object of a second aspect of the present invention is to make it possible to display a self-diagnostic check for each stage of operation and the details of the check, and to perform the check appropriately and speedily, thereby remarkably improving the reliability.

Furthermore, data on execution by the excavator is in many cases stored in a backup memory so that its contents will not be lost even in the case of a power failure or the like. In this case, as a method of its storage, it is desirable to ensure that the essential operating efficiency will not be impaired. A third aspect of the present invention is aimed at providing a method of storage which is suited to an auger-type excavator of a single-process construction method.

DISCLOSURE OF THE INVENTION

Accordingly, in accordance with a first aspect of the present invention, there is provided a controlling apparatus for an excavator having an excavating cutter at a distal end thereof for excavating in the ground by rotating the cutter by means of a cutter-rotating actuator and by advancing the excavator by means of an advancing actuator, characterized by comprising:

input means for inputting a soil condition at a place where the excavator advances;

setting means for setting a reference number of revolutions of the cutter and a reference advancing speed of the excavator in correspondence with the soil condition inputted by the input means;

load-detecting means for detecting a load applied to each of the actuators;

number-of-revolutions controlling means for controlling the cutter-rotating actuator so as to obtain the reference number of revolutions set by the setting means; and speed-controlling means for controlling the advancing actuator so as to obtain the reference advancing speed set by the setting means if it is detected by the load-detecting means that the load on each of the actuators is within a predetermined range, and for controlling the advancing actuator so as to decrease or increase the advancing speed more than the reference advancing speed if it is detected by the load-detecting means that the load on either of the actuators is outside the predetermined range.

In addition, in accordance with a second aspect of the present invention, there is provided a controlling apparatus for an excavator having input means for inputting data for operating the excavator, sensors for detecting states of various parts of the excavator, actuators for driving the various parts of the excavator, a controller for performing predetermined processing and controlling the driving of the actuators on the basis of the data inputted by the input means and values detected by the sensors so as to operate the excavator, and display means for displaying a result of processing by the controller, wherein the excavator, the input means, the sensors, the actuators, the controller, and the display means are connected by means of wire or radio transmission, characterized in that:

if operation-stage data indicating a respective stage of operation is inputted by the input means, or if the stage of operation is detected by a predetermined one of the sensors, the controller conducts in correspondence with the inputted or detected stage of operation a check of functions of the input means and each part of the controller, an abnormality check of the values detected by the sensors on the basis of the values detected by the sensors, a check of states of operation of the actuators on the basis of the values detected by the sensors, or a check of a state of transmission of a signal in the wire or radio transmission, and results of the checks are displayed on the display means.

Furthermore, in accordance with a third aspect of the present invention, there is provided a controlling apparatus for an excavator having an excavator which is advanced in units of one stroke and in which a predetermined re-setup is provided after completion of each stroke, sensors for detecting states of various parts of the excavator, an actuator for advancing the excavator in units of one stroke, input means for inputting data for operating the excavator, a controller for performing predetermined processing and controlling the driving of the actuator on the basis of the data inputted by the input means and values detected by the sensors so as to operate the excavator, and a storage medium for storing results of processing by the controller, characterized in that:

there is provided detecting means for detecting that the excavator has advanced by one stroke; and that the controller prepares execution data on the basis of the values detected by the sensors, and each time the advance of the excavator by one stroke is detected by the detecting means, the controller turns off the actuator and effects processing in which the prepared execution data is Written in the storage medium.

In accordance with the arrangement of the first aspect of the present invention, the soil condition at the place where the excavator is advanced is inputted. Accordingly, a reference number of revolutions of the cutter and a reference advancing speed of the excavator are set in correspondence with the inputted soil condition. On the other hand, a load applied to each actuator is detected. The cutter-rotating actuator is controlled so as to allow the set reference number of revolutions to be obtained for the cutter. If it is detected that the load on each of the actuators is within a predetermined range, the advancing actuator is controlled so as to allow the set reference advancing speed to be obtained for the excavator. However, if it is detected that the load on either of the actuators is outside the predetermined range, this is the case where the soil condition has changed, so that the advancing actuator is controlled so as to decrease or increase the advancing speed more than the set reference advancing speed. As the advancing actuator is thus controlled in correspondence with the consecutively changing soil condition, it is possible to effect speed control capable of coping with the change of the soil condition.

In a similar manner, in Claim 3, a change in the soil condition is ascertained from the history of the position and attitude in the past, and control of direction correction is effected correspondingly. In Claim 4, a pinch valve is controlled in correspondence with the change in the soil condition, and, in Claim 5, water injection is controlled in correspondence with the change in the soil condition.

In addition, in accordance with the second aspect of the present invention, operation-stage data indicating a respective stage of operation is inputted by the input means, or is detected by one of the sensors. In correspondence with the details of the inputted or detected stage of operation, the controller conducts a check of functions of the input means and each part of the controller, an abnormality check of the values detected by the sensors on the basis of the values detected by the sensors, a check of states of operation of the actuators on the basis of the values detected by the sensors, or a check of a state of transmission of a signal in wire or radio transmission, and results of the checks are displayed on the display means. Thus, checks are conducted appropriately and speedily.

Furthermore, in accordance with the third aspect of the present invention, the advance of the excavator by one stroke is detected, and each time the advance of the excavator by one stroke is detected, the controller turns off the actuator and effects processing in which data on execution during the advance by one stroke on the basis of the values detected by the sensors is written in a storage medium. As a result, the execution data for each stroke in the auger-type excavator of a single-process construction method is stored consecutively during re-setups during which advancing is not effected, so that the operating efficiency of the excavator is not impaired.

BEST MODE FOR CARRYING OUT THE INVENTION

Figure 1:
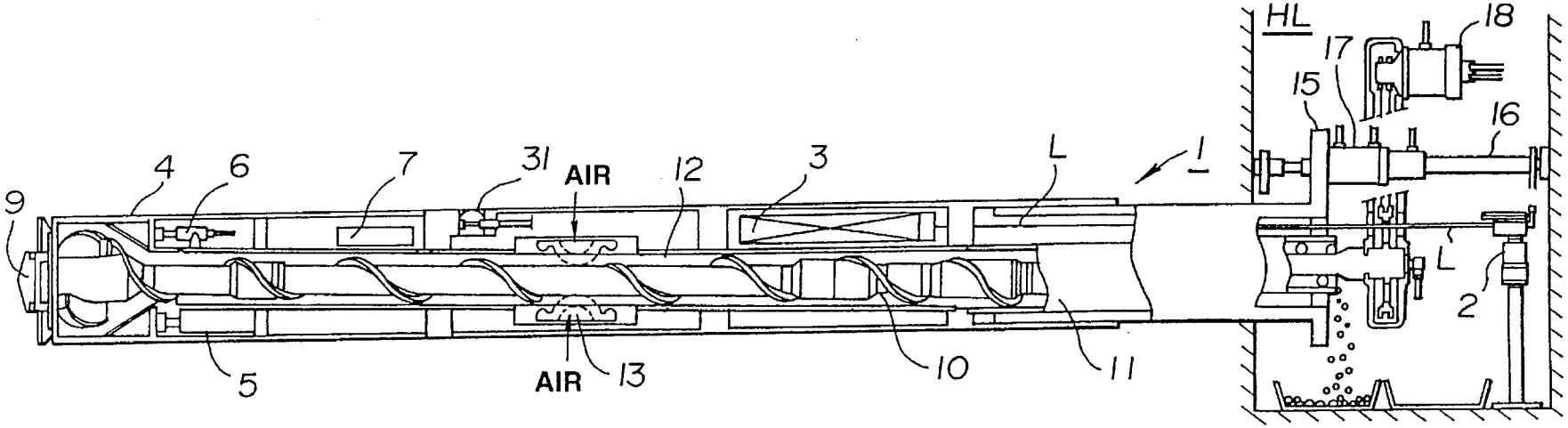
FIG. 1 is a diagram illustrating a horizontal cross section of a small-bore-pipe excavator applied to an embodiment of a controlling apparatus for an excavator in accordance with the present invention.

Referring now to the drawings, a description will be given of the embodiments of a controlling apparatus for an excavator in accordance with the present invention.

Figure 2:
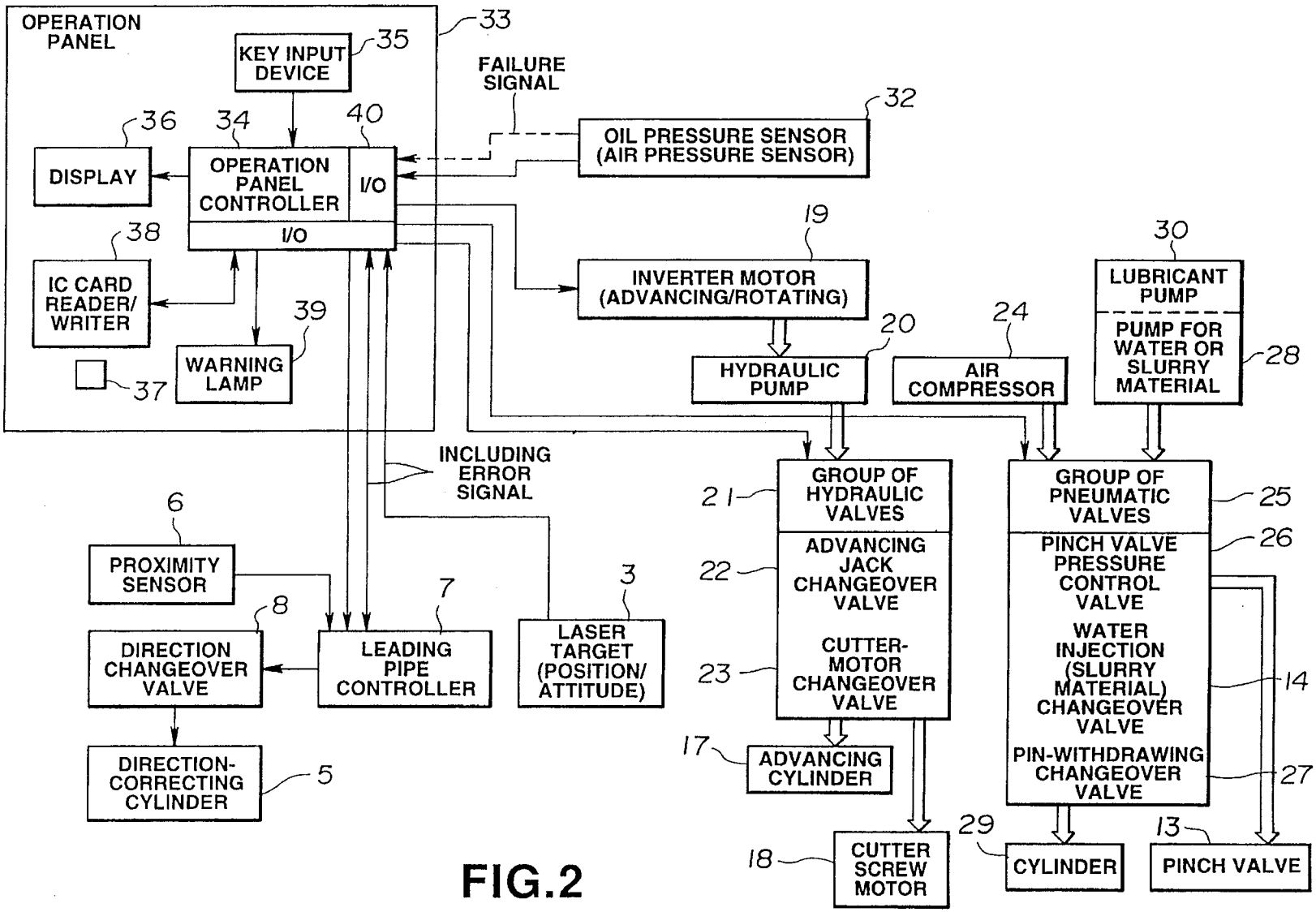
FIG. 2 is a block diagram illustrating a configuration of the controlling apparatus in accordance with the embodiment.
Figure 3:
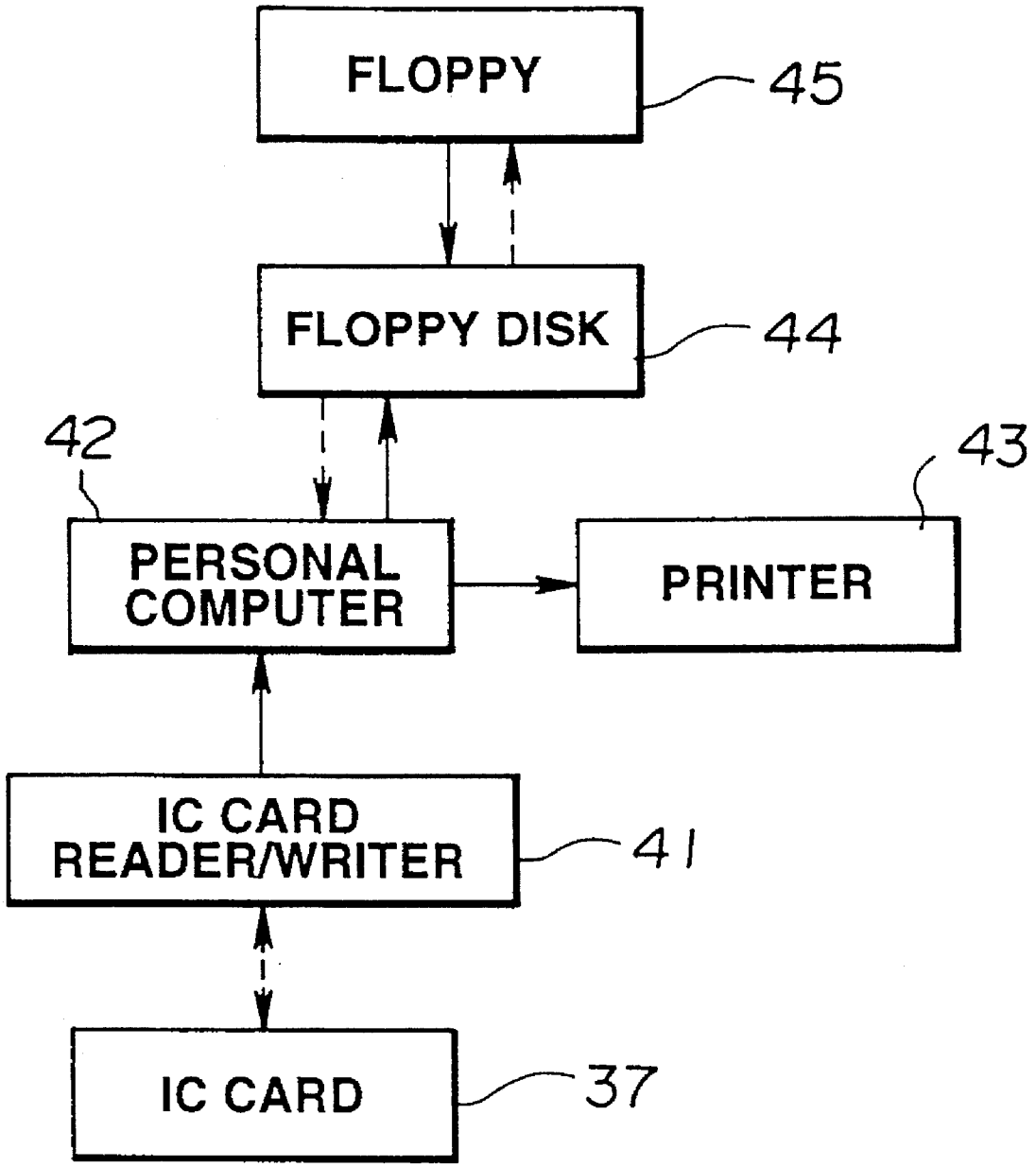
FIG. 3 is a block diagram illustrating a configuration of a device for processing execution data in accordance with the embodiment.

FIG. 1 shows a horizontal cross section of a small-bore underground excavator 1 (hereafter simply referred to as the "excavator 1") which is applied to the embodiment. FIG. 2 shows a block diagram of a configuration of a controlling apparatus of the embodiment. FIG. 3 shows a block diagram of a device for analyzing execution data. It should be noted that the excavator 1 functions as a leading pipe for a pipe to be buried, such as a gas pipe.

As shown in these drawings, a laser theodolite 2 is disposed in a starting shaft HL, whereby the present position and the present attitude angle of the excavator 1 are detected in correspondence with an irradiating position of a laser beam L Which is emitted toward a laser target 3 in the excavator 1. It should be noted that the details of the position and attitude angle through the irradiation with this laser beam are publicly known through, for instance, Japanese Patent Application No. 312199/1989 filed by the present applicant, and since they are not directly related to the main gist of the present invention, description thereof will be omitted.

Figure 11A:
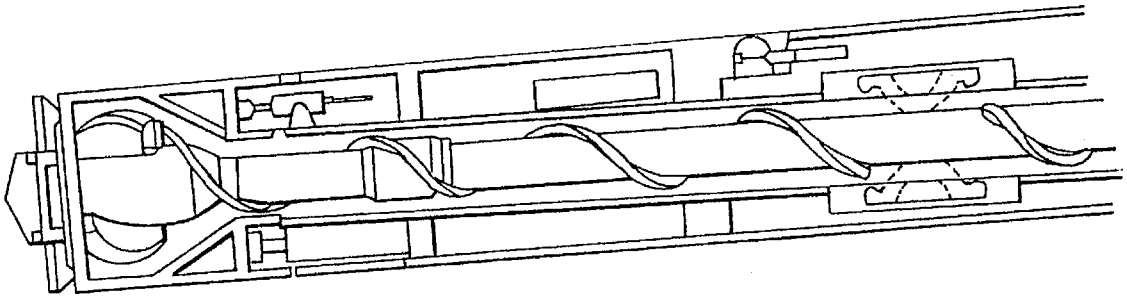
FIG. 11(*a*)–11(*c*) are an enlarged cross-sectional view of the cutter heads shown in FIG. 1, illustrating the swinging action of the cutter head.
Figure 11B:
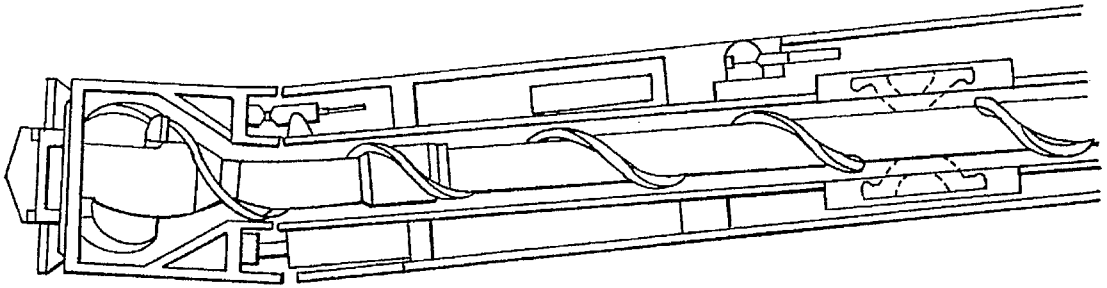
Figure 11C:
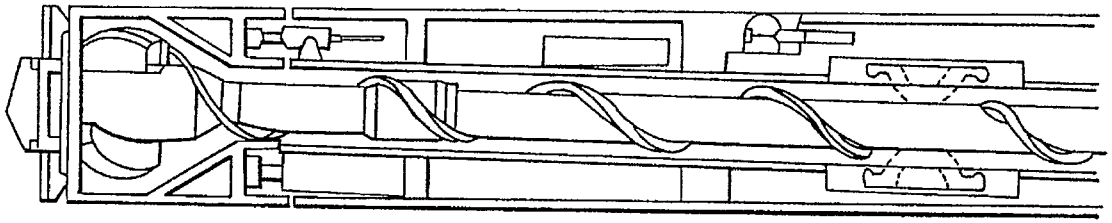

In FIG. 1, a cutter head 4 is disposed at a distal end of the excavator 1 in such a manner as to be capable of being swung, as illustrated in FIG. 11(*a*)– 11(*c*) by a direction-correcting cylinder 5 which is oriented to head toward upper and lower, and left and right directions, and its swinging angle is detected by a proximity sensor 6. The angle detected by the proximity sensor 6 is fed back to a leading-pipe controller 7, which controls the driving of the direction-correcting cylinder 5 via a direction changeover valve 8 (see FIG. 2). A cutter 9 is disposed at a distal end of the cutter head 4, and excavation is effected as this cutter 9 rotates. The cutter 9 is formed integrally with a screw 10 (a so-called auger) arranged in the longitudinal direction of the excavator 1, and this screw 10 serves to discharge in the rear direction the earth and sand at a working face excavated by the cutter 9 as the screw 10 rotates together with the cutter 9.

The screw 10 is covered with a casing 11, and the removed earth and sand passes through a passage 12 between the casing 11 and the screw 10. A pinch valve 13 for changing the cross-sectional area of the passage 12 in correspondence with the pressure of air applied is disposed midway in the passage 12.

In addition, an unillustrated water injection port is provided in the passage 12 forwardly of the pinch valve 13, and a slurry material or water is injected into the passage 12 through this water injection port. The slurry material or the like is fed to the water injection port by means of a water-injection changeover valve 14 (see FIG. 2 ) disposed on the ground, for instance. When the water-injection changeover valve 14 is operated and the slurry material is poured into the passage 12, the removed sandy soil is set in the form of a slurry, so that the removed soil can pass through the passage 12 without applying an excessively large load onto the screw 10. Similarly, when the water-injection changeover valve 14 is operated and water is injected into the passage 12, the removed soil is made into a liquid state when the removed soil is clay, so that the discharged soil can pass through the passage 12 without applying an excessively large load onto the screw 10.

In the starting shaft HL, a pressing plate 15 formed integrally with the excavator 1 is disposed in such a manner as to be moveable in the longitudinal direction of a reaction-force bar 16. The pressing plate 15 is driven by an advancing cylinder 17 in the leftward direction as viewed in the drawing so as to advance the excavator 1. Here, the process in which the advancing cylinder 17 moves as far as it can reach in the longitudinal direction of the reaction-force bar 16 is referred to as "one stroke." When the excavator 1 is advanced by one stroke, a predetermined re-setup is carried out in the starting shaft HL so as to advance the excavator 1 again by another stroke. It should be noted that, depending on the type of excavator, there are cases where a pipe to be buried is connected to the rear of the excavator after completion of one stroke, and there are cases where the pipe to be buried is connected after a plurality of strokes (e.g., two and a half strokes).

Meanwhile, a hydraulic motor 18 is disposed in the starting shaft HL, and as this hydraulic motor 18 is driven, the screw 10 and the cutter 9 are rotated by means of a predetermined transmitting mechanism.

In FIG. 2, an inverter motor 19 is a driving source of a hydraulic pump 20, and pressure oil discharged from this hydraulic pump 20 is supplied to a group of hydraulic valves 21. The group of hydraulic valves 21 is mainly comprised of an advancing-jack changeover valve 22 and a cutter-motor changeover valve 23. As the advancing-jack changeover valve 22 and the cutter-motor changeover valve 23 are respectively operated as required, the pressure oil is supplied to the advancing cylinder 17 and the hydraulic motor 18 for driving the cutter 9 and the screw 10, and they are driven.

Meanwhile, an air compressor 24 is a driving source of a pneumatic circuit, and air discharged from this air compressor 24 is supplied to a group of pneumatic valves 25. The group of pneumatic valves 25 is mainly comprised of a pinch-valve-pressure controlling valve 26, the aforementioned water-injection changeover valve 14, and a pin-withdrawing changeover valve 27. Of these valves, when the pinch-valve-pressure controlling valve 26 is operated, air of a predetermined pressure is applied to the pinch valve 13, thereby changing the cross-sectional area of the aforementioned passage 12. In addition, when the water-injection changeover valve 14 is operated, water or the slurry material is supplied to the pass age 12, as described above, by means of a pump 28 for water or a slurry material. Further, when the pin-withdrawing changeover valve 27 is operated, a cylinder 29 for a re-setup is driven, whereby a re-setup after completion of one stroke is effected. A lubricant pump 30 is provided for supplying a lubricant to the surface of the excavator 1, and the lubricant is discharged to the surface of the excavator 1 through a lubricant discharging port 31 (see FIG. 1) during advancing, thereby allowing advancing to be effected smoothly.

Oil/air pressure sensors 32 are pressure sensors which are disposed in major portions of the hydraulic circuit and the pneumatic circuit described above.

An operation panel 33 is located at a place which facilitates operation by an operator in the starting shaft HL or on the ground, and is comprised of an operation panel controller 34 which is mainly composed of a CPU and a memory; an input device 35 constituted mainly by a keyboard; a display 36 such as a CRT having a display screen; an IC card reader/writer 38 for writing in and reading from an IC card 37; and a warning lamp 39 which informs the operator to the effect that the excavator is being advanced as the warning lamp 39 flashes.

The operation panel controller 34 has an input/output board 40, through which signals from the various sensors are inputted and control signals for the various actuators described above are outputted. Namely, detection signals from the oil/air pressure sensors 32, together with failure signals, are inputted to the controller 34; a control signal is outputted to the inverter motor 19; control signals are outputted to solenoids of the group of pneumatic valves 25 and the group of hydraulic valves 21; and detection signals concerning the position and attitude angle from the laser target 3, together with error signals, are inputted to the controller 34. Then, the leading-pipe controller 7 is controlled via the input/output board 40, and at the same time error signals are inputted to the controller 34. Further, a signal for flashing the warning lamp 39 is outputted via the input/output board 40, a control signal for writing is outputted to the IC card reader/writer 38, and the contents which have been read are inputted to the controller 34.

The input device 35 is for inputting data for operating the excavator 1 by means of the keyboard, and the data is fetched into the controller 34. The controller then displays a predetermined result of processing on the display 36, thereby imparting necessary information to the operator.

Hereinafter, a description will be given of processing which is executed by the CPU of the operation panel controller 34. It should be noted that it is assumed that a processing program is stored in the memory of the CPU, and is executed as the operator performs a keying operation on the keyboard, as required.

If it is assumed that the data on execution by the excavator 1 is stored in the IC card 37, the operator is able to remove the IC card 37, carry it, and load it into an IC card reader/writer 41 installed in a building for analyzing the execution data, as shown in FIG. 3. Then, the operator is able to analyze the execution data by using a general purpose computer comprising a personal computer 42, a floppy disk 45, a floppy disk drive 44, and a printer 43.

Complex Control of the Excavator

Figure 4A:
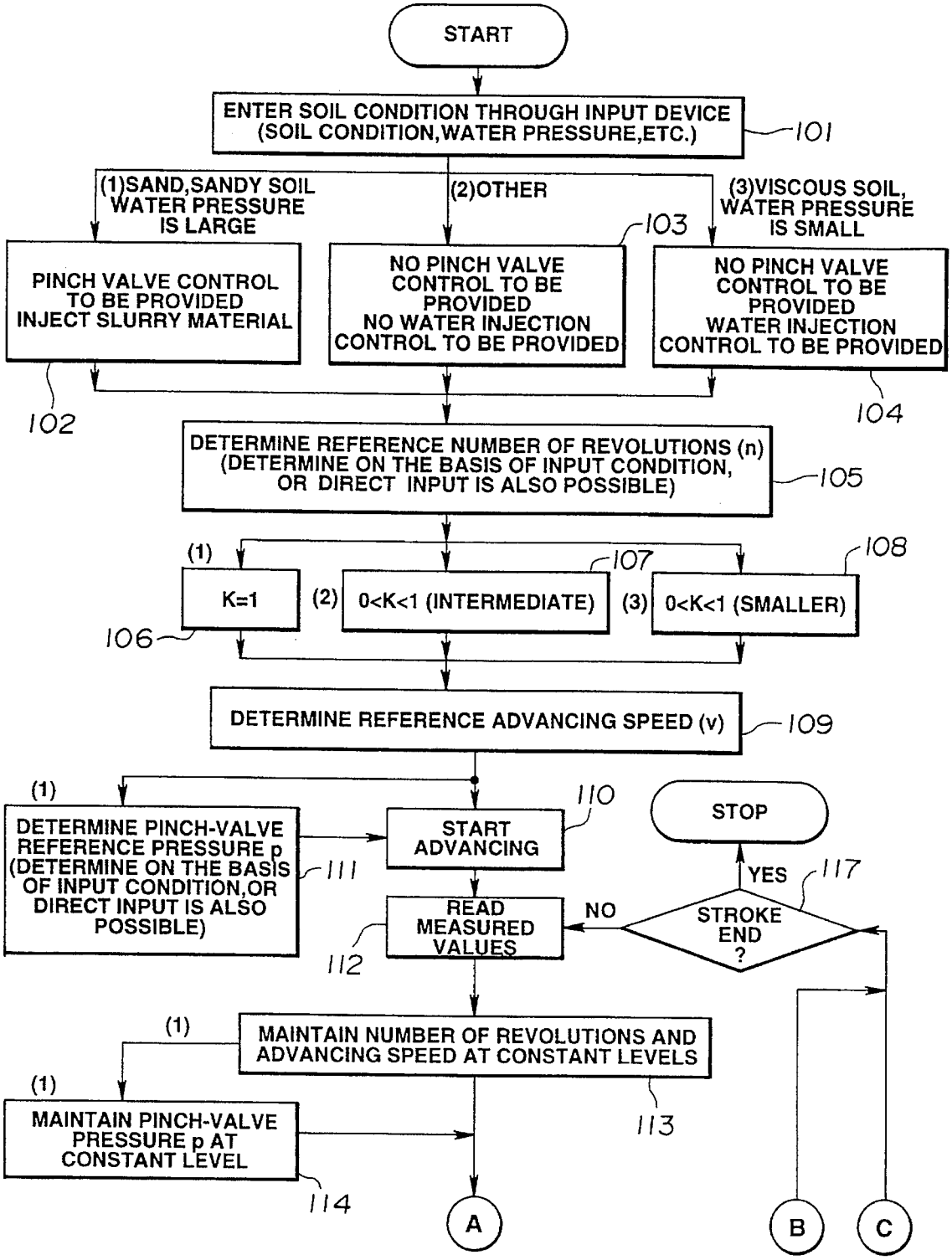
FIGS. 4*a* and 4*b* are flowcharts illustrating a processing procedure of complex control in accordance with the embodiment.
Figure 4B:
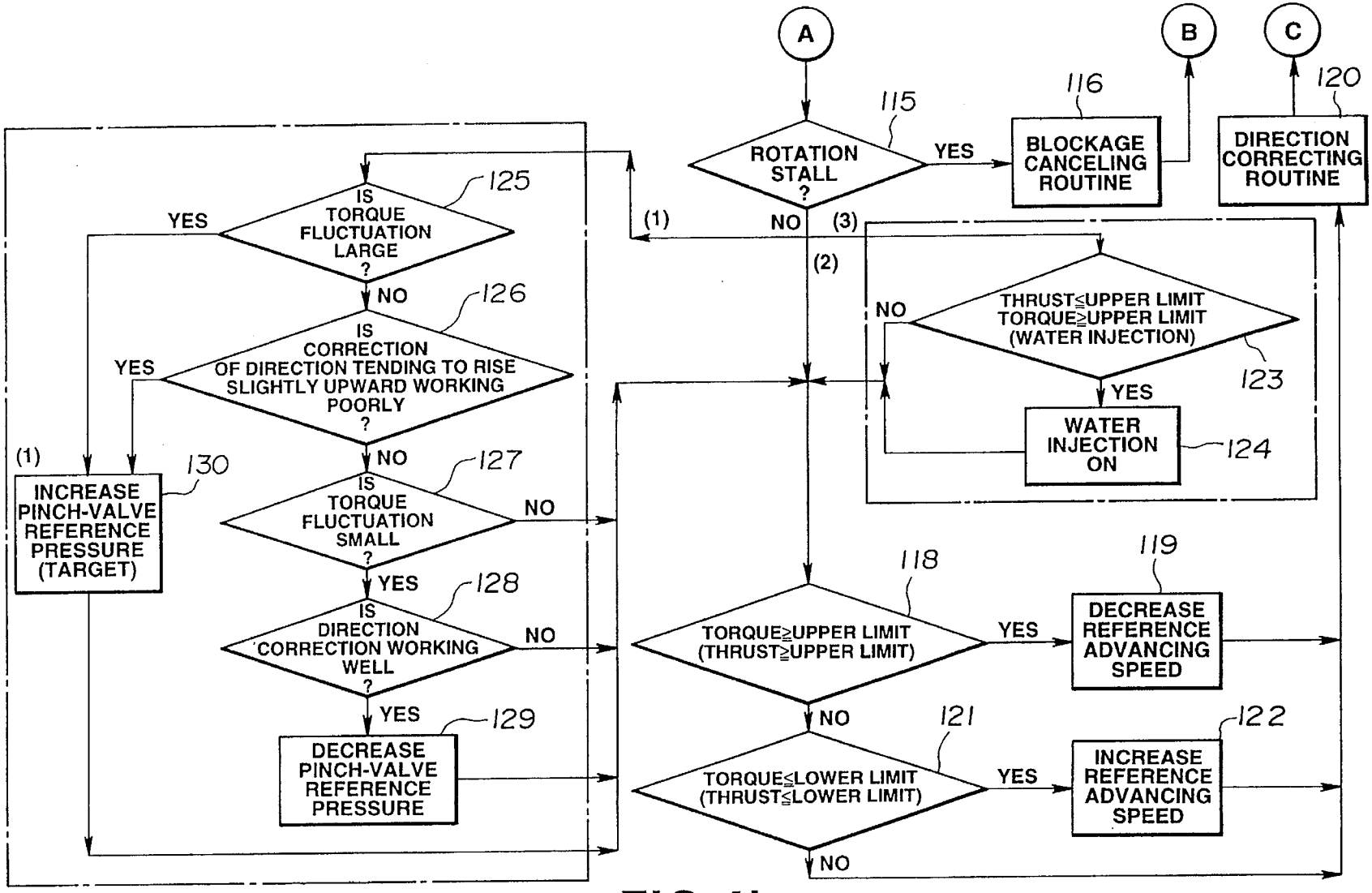

When a "start of execution of complex control" is instructed through the keying operation on the keyboard, the CPU of the operation panel controller 34 starts the processing shown in FIGS. 4*a* and 4*b*. It should be noted that it is assumed that the execution of this processing is started at the stage of an advancing start after the excavator 1 is set in the starting shaft HL.

First, data on the soil condition at the place where the advancing of the excavator 1 is carried out is inputted by means of the input device 35. Here, it is assumed that the soil condition data referred to includes data which literally represents the type of soil, indicating that the soil at the working face is sand, sandy soil, clayish soil, or the like, and in a case where water is contained at the working face, the soil condition data includes at least data on the pressure of water acting on the front face of the excavator 1 (cutter 9), i.e., the so-called water pressure (Step 101).

Then, a determination is made as to whether or not predetermined control is to be effected, depending on the details of the inputted soil condition data.

Namely, if the type of soil is sand or sandy soil, and if the water pressure is equal to or greater than a predetermined threshold value, this condition is classified as a soil condition (1). Then, a determination is made that control is to be executed for varying the cross-sectional area of the passage 12 by means of the pinch valve 13 (hereafter this control will be referred to as "pinch valve control"), and a determination is made that control is to be executed for supplying the slurry material to the passage 12 by means of the water-injection changeover valve 14. As a result, the water-injection changeover valve 14 is operated, and the slurry material is supplied to the passage 12 to set the removed sandy soil in the form of a slurry, so that the removed soil can pass through the passage 12 without applying an excessively large load onto the screw 10 (Step 102).

Meanwhile, if the type of soil is clayish soil, and if the water pressure is smaller than the aforementioned threshold value, this condition is classified as a soil condition (3). Then, a determination is made that the aforementioned pinch valve control is not to be executed, and a determination is made that control is to be executed for supplying water to the passage 12 by means of the water-injection changeover valve 14 (hereafter this control will be referred to as "water injection control"). As a result, the air pressure at the pinch valve 13 thereafter remains zero, so that the across-sectional area of the passage 12 becomes maximum (Step 104).

On the other hand, in the case of a soil condition which belongs to neither of the aforementioned soil conditions (1) and (3), that soil condition is classified as a soil condition (2). Then, a determination is made that neither the pinch valve control nor the water injection control is to be executed. As a result, the cross-sectional area of the passage 12 becomes maximum, and no water is supplied to the passage 12 (Step 103).

Next, a reference number of revolutions, n, of the cutter 9 is set in correspondence with the details of the inputted soil condition data. This is based on the fact that, if the soil differs, the relative difficulty of excavation differs, and the number of revolutions of the cutter 9 needs to be Changed correspondingly. The numbers of revolution, n, corresponding to the types of soil are stored in the memory in advance, and a corresponding n is read out. It should be noted that data representing the reference number of revolutions, n, corresponding to the soil at the site may be directly inputted from the input device 35 (Step 105).

Next, the advancing speed v of the excavator 1 is similarly set in correspondence with the details of the soil condition data. This is also based on the fact that, if the soil differs, the relative difficulty of advancing differs, and the advancing speed v needs to be changed correspondingly. Here, the following relation holds with respect to a cross-sectional area of excavation, i.e., an area A of the cutter 9, a cross-sectional area a of the screw 10, a pitch 1 of the screw 10, and the advancing speed v:

$$v=k\cdot a\cdot n/A \tag{1}$$

where k is a coefficient.

Accordingly, the coefficient k is set as shown below in correspondence with the soil conditions (1), (2), and (3):

In the case of the soil condition (1): k=1 (Step 106).

In the case of the soil condition (2): k is set in the range of $0<k<1$, and in the vicinity of an intermediate value therebetween (Step 107).

In the case of the soil condition (3): k is set in the range of $0<k<1$, and at a value smaller than in the case of the soil condition (2) (Step 108).

Then, the coefficient set in Steps 106 to 108 is substituted in Formula (1) above to determine the reference advancing speed v. It should be noted that, as the reference advancing speed v, a value corresponding to the type of soil at the site may be inputted directly from the input device 35. The reference advancing speed v thus obtained changes in correspondence with the change at the working face as the excavator advances (Step 109).

Advancing is subsequently started (Step 110), and in the case of the soil condition (1), i.e., if it is determined that the pinch valve control is to be executed, the reference pressure of the pinch valve 13 is set to a predetermined value p. Here, it is assumed that the pinch-valve reference pressure p is set by being classified into small groups in correspondence with the details of the inputted soil condition even in the same soil condition (1). It should be noted that the pinch-valve reference pressure p corresponding to the type of soil at the site may be inputted directly from the input device 35 (Step 111).

As advancing is started, measured values from various sensors are consecutively inputted (Step 112), and the various actuators are controlled. Here, the reference number of revolutions, n, set in Step 105 above is set as a targeted value of the number of revolutions of the cutter 9, and the hydraulic motor 18 is controlled in such a manner that the number of revolutions is maintained constantly at this targeted value. In addition, the reference advancing speed v set in Step 109 above is set as a targeted value of the advancing speed, and the advancing cylinder 17 is controlled in such a manner that the advancing speed is maintained constantly at this targeted value (Step 113). Additionally, in the case of the soil condition (1) in which the pinch valve control is effected, the reference pressure p set in Step 111 above is set as a targeted value of the pressure of the pinch valve 13, and the pinch valve 13 is controlled in such a manner that the pressure is maintained constantly at the reference pressure p (Step 114).

Figure 8:
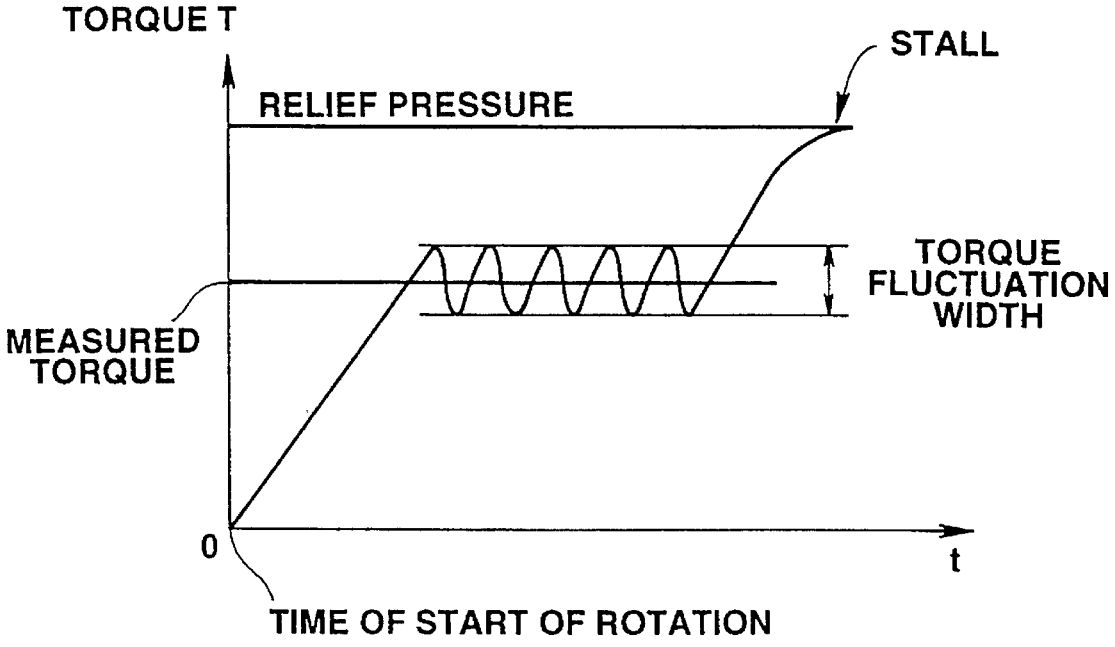
FIG. 8 is a graph illustrating a change over time of a torque applied to a cutter and a screw of the excavator in accordance with the embodiment.

Next, a determination is made as to whether or not a rotation stall has occurred at the cutter 9 on the basis of the detection signal from the sensor for detecting the torque of the cutter 9, i.e., a load T, among the oil/air pressure sensors 32. Here, FIG. 8 illustrates the relationship between the time t and the torque T of the cutter 9. The torque T rises from the start of rotation, and, in a Steady state, the torque fluctuates with a predetermined width of torque fluctuation. In this case, the sensor measures a mean value of the width of torque fluctuation. In due course of time, when the removed soil is stuck in the passage 12, and the passage 12 is blocked, a rotation stall occurs in the cutter 9 and the screw 10. This causes the torque T to reach the relief pressure, thereby making it impossible to excavate and remove the soil. Therefore, when the measured torque T reaches the predetermined threshold value or more, a determination is made that an rotation stall has occurred (Step 115).

Figure 5:
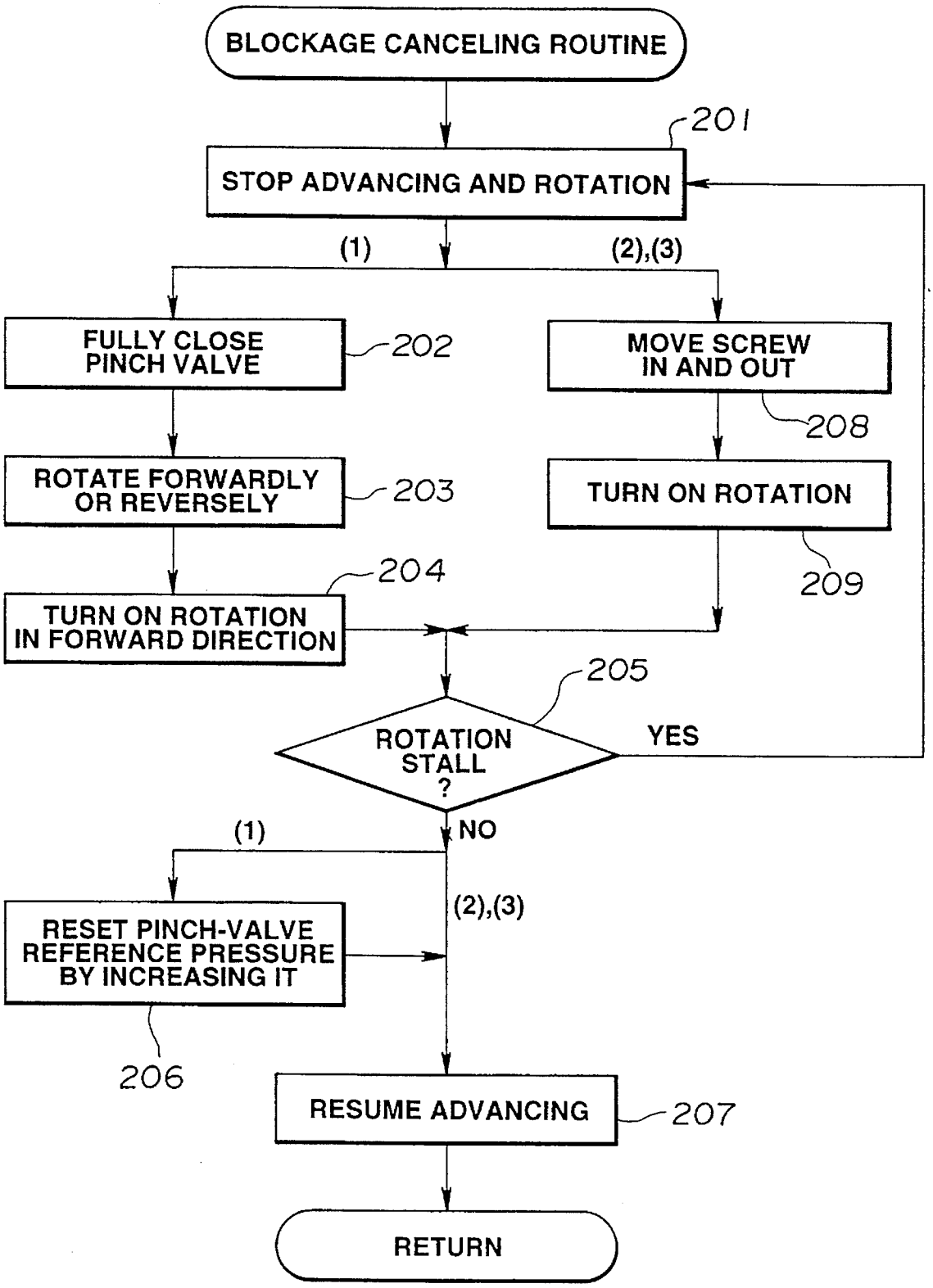
FIG. 5 is a flowchart illustrating a processing procedure of a blockage canceling routine in accordance with the embodiment.

If it is determined that the torque T is equal to or greater than the aforementioned threshold value (YES in the determination in Step 115), the operation proceeds to the "blockage canceling routine" shown in FIG. 5 so as to avoid a situation in which excavation or removal of soil becomes impossible (Step 116).

In the "blockage canceling routine," control is first effected to completely stop the advancing of the excavator 1 and the rotation of the cutter 9, thereby preventing the aggravation of the situation (Step 201). Subsequently, in the case of the soil condition (1) in which the pinch valve control is effected, the pinch valve 13 is controlled in such a manner that the cross-sectional area of the passage 12 becomes minimum (Step 202). Then, the removal of the filled earth and sand is promoted by controlling the rotation of the screw 10 in the forward or reverse direction, as required (Step 203). Subsequently, the rotation of the screw 10 is set in the forward direction (Step 204), and a determination is made as to whether or not a rotation stall has occurred again (Step 205). As a result, if the rotation stall has been overcome (NO in the determination in Step 205), the pinch-valve reference pressure is reset in such a manner as to be greater than the reference pressure p set in Step 111, and control is effected such that the cross-sectional area of the passage 12 becomes smaller in correspondence with the reset pressure. In other words, a measure is provided to ensure that the rotation stall will not occur again (Step 206). Then, the stoppage of the advancing of the excavator 1 and of the rotation of the cutter 9 is canceled, and advancing is resumed (Step 207).

Meanwhile, if the rotation stall has not yet been overcome (YES in the determination in Step 205), the rotation is stopped again, and similar processing is repeatedly executed.

On the other hand, in the cases of the soil conditions (2) and (3) in which the pinch valve control is not executed, this is the case where the removed soil is stuck even when the cross-sectional area is maximum, so that the screw 10 is moved in and out, i.e., is moved relatively in the longitudinal direction of the excavator 1, so as to remove the earth and sand (Step 208). The rotation of the cutter 9 is then turned on (Step 209). Thereafter, in the same way as in the case of the soil condition (1), a determination is made as to the presence or absence of the occurrence of a rotation stall (Step 205), and if the rotation stall has been overcome, advancing is resumed (Step 207).

After completion of the "blockage canceling routine," the operation returns to Step 117 to determine whether or not one stroke has been completed, i.e., whether or not the pressing plate 15 has moved as far as it can reach in the longitudinal direction of the reaction-force bar 16. The completion of one stroke may be detected by a predetermined sensor, and the determination may be made from a detection signal therefrom. Alternatively, the operator may enter data representing the "completion of one stroke" by means of the keyboard, and the determination may be made from that input data. If one stroke is completed (YES in the determination in Step 117), advancing is stopped, and a re-setup such as the connection of a pipe to be buried to the rear of the leading pipe 1 is required, so that this processing which is required only during the execution of advancing ends.

Meanwhile, if it is determined that one stroke has not yet been completed (NO in the determination in Step 117), the operation returns to Step 112, and processing such as the inputting of measured values of the respective sensors is repeatedly executed.

Now, if it is determined in Step 115 that a rotation stall has not occurred, processing corresponding to the soil condition (1), (2) or (3) is executed without executing the "blockage canceling routine."

First, in the case 0f the soil condition (2) in which neither the pinch valve control nor the water injection control is executed, only the control for varying the reference advancing speed v (hereafter this control will be referred to as the "advancing speed control") is carried out in correspondence with the situation at the working face which changes as the excavator advances. Namely, on the basis of a detection signal from a sensor for detecting the thrust F of the excavator 1 among the oil/air pressure sensors 32, a determination is made as to whether or not the thrust F is equal to or Greater than a preset upper limit, or equal to or less than a preset lower limit. Meanwhile, a determination is made as to whether or not the detected torque T is equal to or greater than a preset upper limit, or equal to or less than a preset lower limit.

Therefore, if it is determined that the detected torque T has become equal to or greater than the upper limit, or the detected thrust F has become equal to or greater than the upper limit (YES in the determination in Step 118), this is the case where the load on the excavator 1 is large and excavation is difficult. Accordingly, the reference advancing speed is reset to a value smaller than the reference advancing speed v set in Step 109 above, and the advancing speed of the excavator 1 is maintained constantly at this reset reference advancing speed v (Step 119). Then, the operation proceeds to a "direction correcting routine" which is shown in FIG. 6 and will be described later, so as to control the driving of the direction-correcting cylinder 5 to allow the excavator 1 to advance in a direction along a reference planned line (Step 120).

On the other hand, if it is determined that the detected torque T has become equal to or less than the lower limit, or the detected thrust F has become equal to or less than the lower limit (YES in the determination in Step 121), this is the case where the load on the excavator 1 is small, and there is leeway in advancing. Hence, the reference advancing speed is reset to a value greater than the reference advancing speed v set in Step 109 above, and the advancing speed of the excavator 1 is maintained constantly at this reset reference advancing speed v (Step 122). Then, the operation proceeds to the aforementioned "direction correcting routine" (Step 120).

Furthermore, if it is determined that the detected torque T is in a range greater than the lower limit and smaller than the upper limit, and that the detected thrust F is in a range greater than the lower limit and smaller than the upper limit (NO in both determinations in Steps 118 and 121), this is the case where advancing is being effected smoothly at the reference advancing speed v set in Step 109 above. Hence, the set reference advancing speed v is kept as it is, and the operation proceeds to the aforementioned "direction correcting routine" (Step 120).

Figure 6:
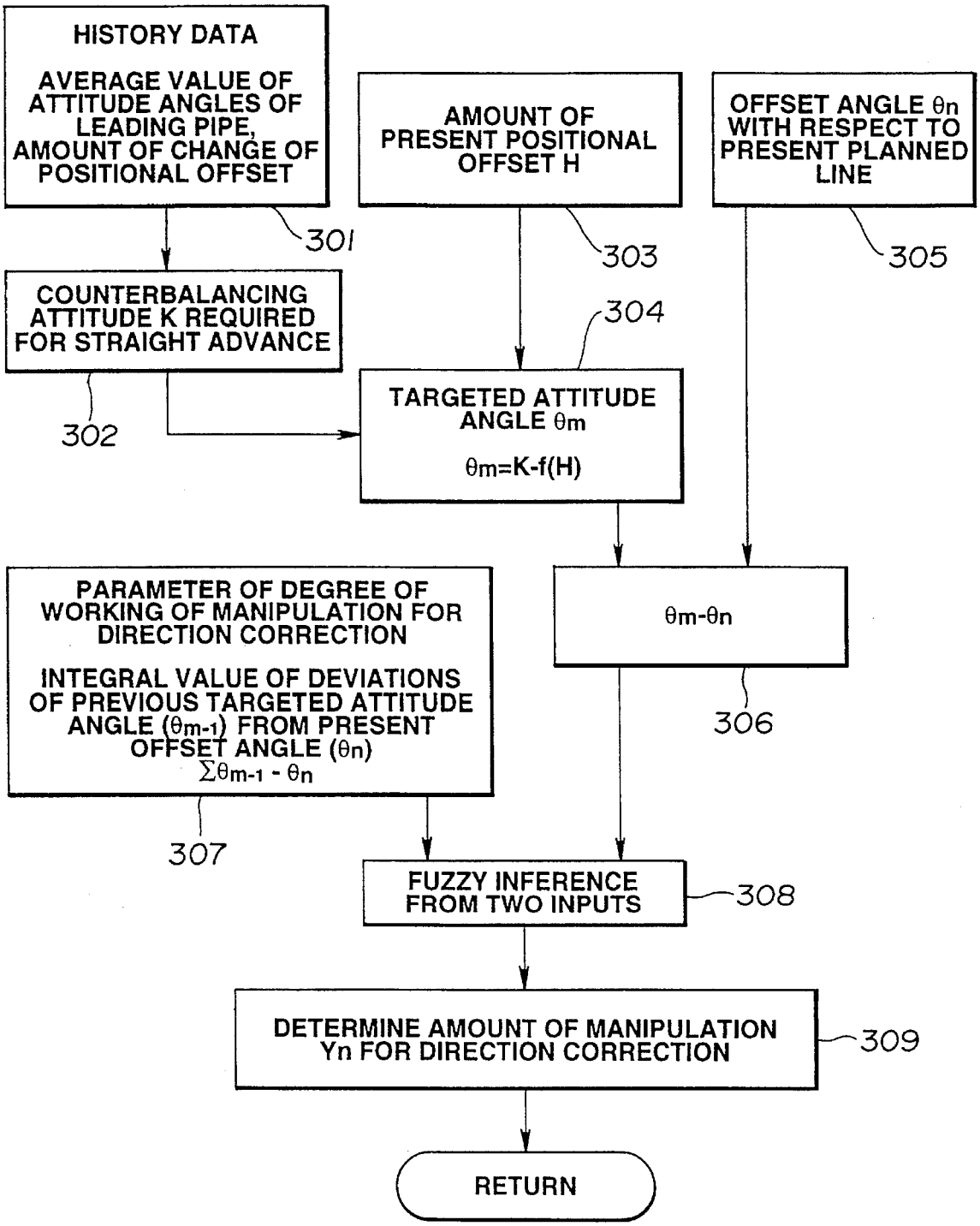
FIG. 6 is a flowchart illustrating a processing procedure of a direction correcting routine in accordance with the embodiment.
Figure 7:
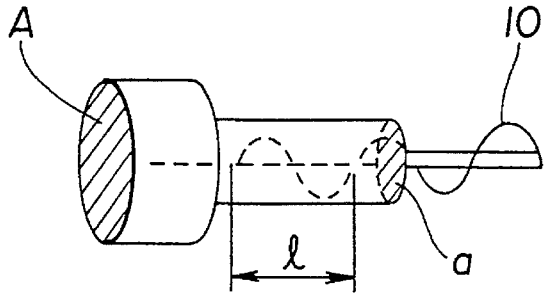
FIG. 7 is a diagram used to explain calculation for determining an advancing speed of the excavator in accordance with the embodiment.

The "direction correcting routine" shown in FIG. 6 is basically similar to the direction control disclosed in Japanese Patent Application No. 179641/1990 filed by the present applicant, but technically differs from the same in that a targeted attitude angle is determined on the basis of the history of direction correction in the past.

That is, at the laser target 3, the consecutive attitude angle of the excavator 1 from the advancing start to the present is detected, and is consecutively stored in the memory. In addition, the consecutive position of the excavator 1 is also detected, a deviation of this consecutive position from a consecutive targeted position is determined, and a consecutive positional offset is stored. Further, an average value of the consecutively detected attitude angles is calculated. In addition, an amount of change of the consecutive positional offset is calculated (Step 301). Then, a counterbalancing attitude K (°) required for the straight advance of the excavator 1 is calculated on the basis of the details calculated in Step 301 (Step 302).

Meanwhile, the present position of the excavator 1 is obtained on the basis of an output signal from the laser target 3, and a deviation of this present position from a present targeted position is obtained as a present positional offset H (Step 303). Then, from the attitude K calculated in Step 302 and the present positional offset H calculated in Step 303 and by using f() as a predetermined function (which may be a constant), a present targeted attitude angle $\theta_m$ is set in accordance with the following Formula (2):

$$\theta_m = K - f(H) \qquad (2)(\text{Step } 304).$$

In addition, the present attitude angle of the excavator 1 is obtained from the output signal from the laser target 3, and an offset angle $\theta_n$ of the present attitude angle with respect to a present targeted advancing direction (planned line) is calculated (Step 305). Then, a deviation $\theta_m - \theta_n$ of the targeted attitude angle $\theta_m$ obtained in Step 304 from the offset angle $\theta_n$ obtained in Step 305 is calculated (Step 306).

The targeted attitude angle $\theta_m$ calculated in Step 304 is consecutively stored in the memory from the advancing start to the previous time (m−1). Similarly, the offset angle $\theta_n$ calculated in Step 305 is consecutively stored in the memory up to the present (n). Accordingly, deviations of the previous targeted attitude angle $\theta_{m-1}$ from the present offset angle $\theta_n$ are added (integrated) up to the present as $\Sigma(\theta_{m-1} - \theta_n)$. The aforementioned integral value means a "direction-correcting speed" (Step 307).

Then, an amount of driving the direction-correcting cylinder 5 is calculated from fuzzy inference based on the aforementioned deviation $\theta_m - \theta_n$ and the direction-correcting speed $\Sigma(\theta_{m-1} - \theta_n)$. It should be noted that this fuzzy inference itself is disclosed in the aforementioned Japanese Patent Application No. 179641/1990, and since it is not directly related to the main gist of the present invention, a description thereof will be omitted (Step 308). Then, an amount of manipulation $Y_m$ of the direction changeover valve 8 for driving the direction-correcting cylinder 5 is calculated, and by imparting this amount of manipulation $Y_m$ to the changeover valve 8, the excavator 1 is advanced along the planned line without deviations (Step 309).

The operation then returns to Step 117 in FIG. 4*a*, and a determination is made as to the completion of one stroke in the same way as described above.

Next, a description will be given of the case of the soil condition (3) in which the water injection control is executed.

If it is determined in Step 115 that a rotation stall has not occurred, a determination is made as to whether or not the detected torque T is equal to or greater than the predetermined upper limit and the detected thrust F is equal to or less than the predetermined upper limit. Here, it should be noted that since the upper limit of the detected torque T is a threshold value for determining whether or not water injection is to be carried out, the upper limit of the detected torque T is set to a value equal to or lower than the upper limit in Step 118 (Step 123).

If YES is the answer in the determination in Step 123, this is the case where there is no problem in advancing itself and a load is being applied to the screw 10 due to the viscous soil, so that water injection control is executed to overcome this situation. As a result, the viscosity is eliminated, and the removal of soil is made smooth, thereby preventing an excessively large load from being applied onto the screw 10 (Step 124). Then, the operation proceeds to Step 118 to execute the above-described advancing speed control and direction correction control. Meanwhile, if NO is the answer in the determination in Step 123, an excessively large load is not being applied onto the screw 10, and it is unnecessary to inject water, so that the operation proceeds to Step 118 to execute the advancing speed control and the direction correction control.

Next, a description will be given of the case of the soil condition (1) in which the pinch valve control is executed.

If it is determined in Step 115 that a rotation stall has not occurred, a determination is made as to whether or not the fluctuation of the detected torque T is within a predetermined range (Step 125), and a determination is made as to whether or not the value of $\Sigma(\theta_{m-1} - \theta_n)$ representing the direction-correcting speed described above is equal to or less than a predetermined value. It should be noted that, in order to determine the direction-correcting speed, a parameter other than that, such as the advancing speed, may also be incorporated (Step 126). If YES is the answer in either of the determinations in Step 125 and 126 above, it is determined that the excavator 1 is tending to slightly rise upward, and that the advance along the planned line is becoming difficult. Hence, to overcome this situation, the pinch-valve reference pressure is reset to a value greater than the pinch-valve reference pressure p set in Step 111, and the pinch valve 13 is controlled in such a manner as to be maintained at this reset value (Step 130). Then, the operation proceeds to Step 118 in which the above-described advancing speed control and direction correction control are executed.

Meanwhile, if NO is the answer in both determinations in Steps 125 and 126 above (YES in the determinations in Steps 127 and 128), it is determined that the excavator 1 is advancing smoothly along the planned line and there is leeway. Hence, the pinch-valve reference pressure is reset to a value smaller than the pinch-valve reference pressure p set in Step 111, and the pinch valve 13 is controlled in such a manner as to be maintained at this reset value (Step 129). Then, the operation proceeds to Step 118 in which the above-described advancing speed control and direction correction control are executed.

Described above are the details of the complex control of the excavator 1. It should be noted that although, in this embodiment, the advancing speed control, direction correction control, pinch-valve control, and water injection control are executed in a complex manner, these items of control may be implemented independently. For instance, only any one of the advancing speed control, direction correction control, pinch-valve control, and water injection control may be executed by omitting other items of control, or arbitrary ones of these items of control may be combined and implemented, as required. At any rate, in accordance with each item of control of the embodiment, the actuators are not controlled primarily on the basis of an initially set soil condition, but the situation at the working face which changes every moment is ascertained by the sensors, and the actuators are controlled while correcting the soil condition. Therefore, the excavation by the excavator 1 is performed with a high degree of precision, and the operating efficiency improves substantially.

There are various stages in the operation by the above-described excavator 1, and can be classified into the following stages in terms of the execution procedure:

(a) An operation-starting stage in which the excavator 1 and peripheral devices are interconnected (hereafter referred to as the "stage of starting the operation"), (b) A stage in which the excavator 1 and the peripheral devices are installed in the starting shaft HL, and advancing is about to be started (hereafter referred to as the "stage of starting advancing"), (c) A stage in which advancing by the excavator 1 is actually started and excavation is being carried out (hereafter referred to as the "stage of executing advancing"), and (d) A stage in which advancing by the excavator 1 is completed by one stroke (hereafter referred to as the "stage of completion of one stroke").

The technology itself is known which, for the purpose of improving the reliability of a system, carries out self-diagnosis and issues a malfunctional warning by monitoring the system on the basis of outputs from various sensors, thereby improving the reliability of the system. However, with the system of the excavator, the details to be diagnosed and the details for which a warning is to be issued differ for each stage of operation, respectively. Accordingly, an embodiment which is described below is designed to effect only the necessary diagnosis and warning in correspondence with each stage of operation so as to attain speedy processing.

Figure 9A:
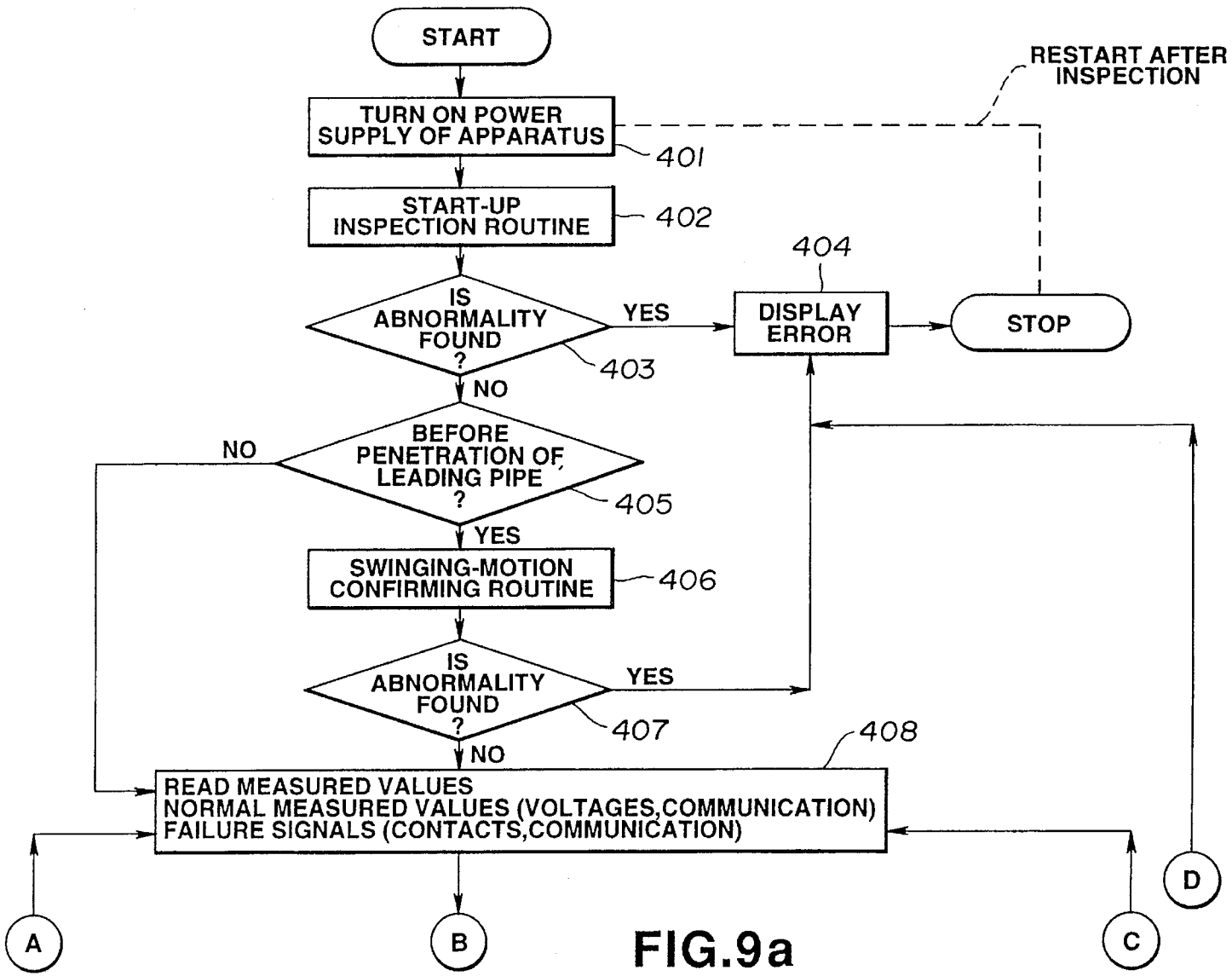
FIGS. 9*a* and 9*b* are flowcharts illustrating a processing procedure of processing of a self-diagnosis and a malfunctional warning in accordance with another embodiment.
Figure 9B:
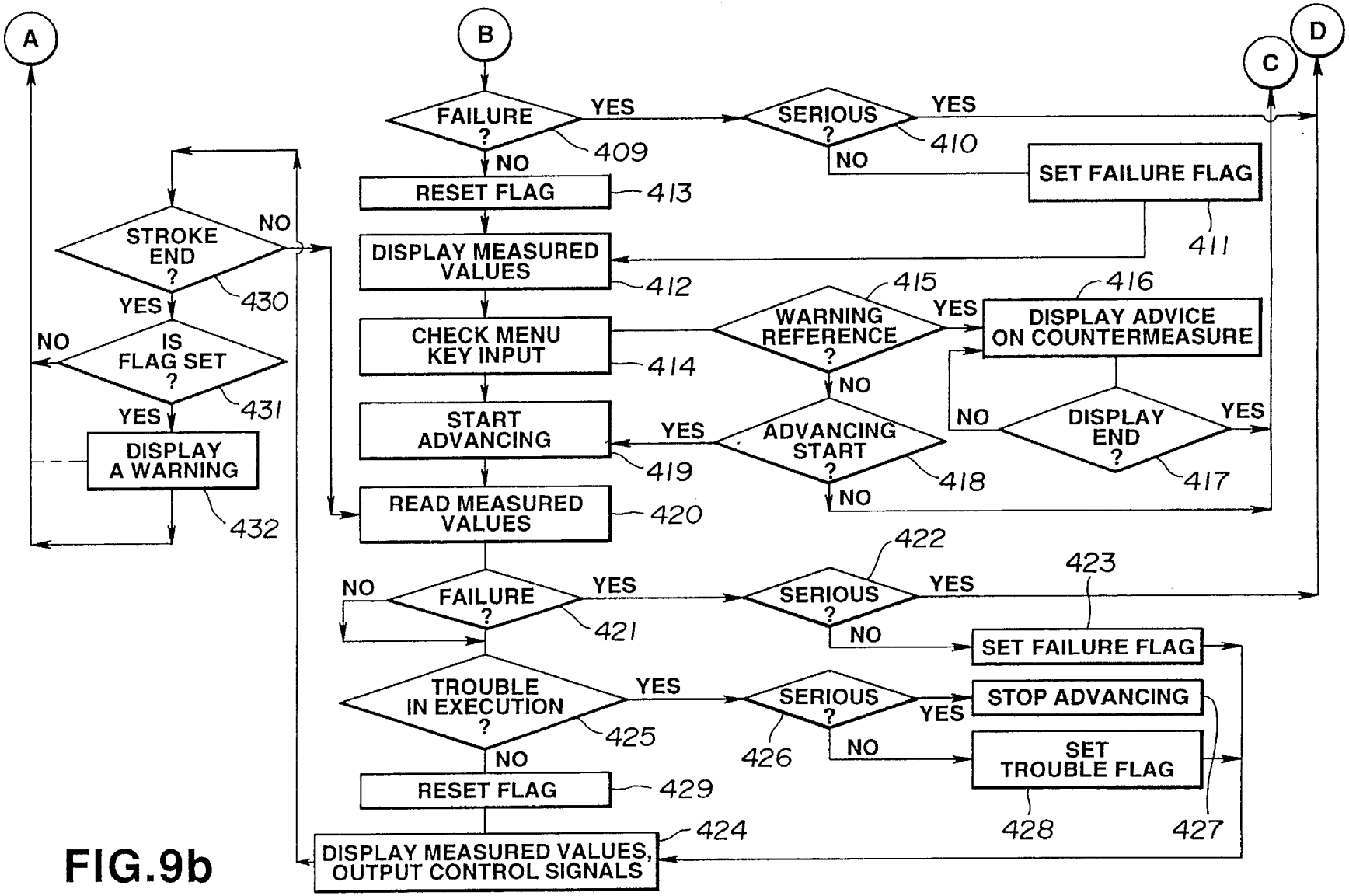

That is, as shown in FIGS. 9*a* and 9*b*, at the stage of starting the operation, the respective devices are interconnected by signal lines, and a power supply is then turned on. The transmission of signals between the devices may be effected by means of radio transmission, as required (Step 401). As the power supply is turned on, the operation proceeds to a "start-up inspection routine." Incidentally, the operation may proceed to the "start-up inspection routine" as the operator enters data representing the "stage of starting the operation" by performing a keying operation on the keyboard of the input device 35. In this "start-up inspection routine", self-diagnosis and malfunctional warning which are adapted for the stage of starting the operation are conducted. As for the details of self-diagnosis, whether the elements of the system are properly connected and the elements operate properly are mainly checked. For instance, a check is made as to whether or not signals from the sensors are being properly inputted to and outputted from the operation panel controller 34 by means of the input/output board (Step 402). As a result, if it is determined that there is an abnormality (YES in the determination in Step 403), the details of the error are displayed on the screen of the display 36 to give a warning to the operator (Step 404), and the operation of the system is stopped.

Subsequently, required inspection is performed, the system is restarted, and the power supply is turned on again in Step 401.

If there is no abnormality at the stage of starting the operation (NO in the determination in Step 403), preparation for an advancing start is made. If the operator enters data representing the "stage of starting advancing" by performing a keying operation on the keyboard of the input device 35 (YES in the determination in Step 405), the operation proceeds to a "swinging-motion confirming routine." In this "swinging-motion confirming routine", self-diagnosis and malfunctional warning which are adapted for the stage of starting advancing are conducted. As for the details of self-diagnosis, the operation of the actuators necessary for advancing is mainly checked. For example, a control signal for driving the direction-correcting cylinder 5 is outputted, as required, and a determination is made as to whether or not the swinging motion of the cutter head 4 is being performed properly on the basis of a detection signal from the proximity sensor 6 (Step 406). As a result, if it is determined that there is an abnormality (YES in the determination in Step 407), the operation returns to the aforementioned Step 404, and an error is displayed on the screen of the display 36.

Meanwhile, if NO is the answer in the determination in Step 405 or NO is the answer in the determination in Step 407, it is determined that the check of swinging motion is completed. Then, detected values from the various sensors such as the laser target 3 and failure signals from the oil/air pressure sensors 32 are inputted (Step 408), and a determination is made as to whether or not a failure has occurred (Step 409). If it is determined that a failure has occurred, a determination is made as to whether or not it is serious under a predetermined standard (Step 410). If it is serious, the operation returns to Step 404, and an error to that effect is displayed. On the other hand, if the failure is not serious, a failure flag is set (Step 411), and measured values of the various sensors are displayed (Step 412).

Meanwhile, if it is determined in Step 409 that a failure has not occurred, the failure flag is reset (Step 413), and the operation proceeds to Step 412 to display measured values of the various sensors.

Next, a menu key is checked (Step 414), and a determination is made as to whether or not a warning reference is to be made (Step 415). As a result, if a warning reference is to be made, advice on a countermeasure is displayed (Step 416), and after the end of displaying (YES in the determination in Step 417), the operation returns to Step 408.

In a case where a warning reference is not to be made, if the operator performs a keying operation on the keyboard of the input device 35 and enters data representing the "stage of executing advancing" (YES in the determination in Step 418), the actuators are driven and controlled to start advancing (Step 419). Then, self-diagnosis and malfunctional warning which are adapted for the stage of executing advancing are conducted. The details of self-diagnosis are the check of trouble in execution, in addition to the check of the aforementioned failure. That is, measured values of the various sensors are read out (Step 420), and if a failure has occurred (YES in the determination in Step 421) and if it is serious (YES in the determination in Step 422), the operation returns to Step 404 to display an error. Meanwhile, if the failure is not serious (NO in the determination in Step 422), a failure flag is set (Step 423), measured values are displayed, control signals are outputted to the actuators, and advancing is resumed (Step 424).

In addition, a determination is made as to trouble in execution on the basis of the measured values of the sensors. For example, a decision is made as to whether the detected attitude angle has become abnormally large, and whether the detected thrust has become abnormally large, in which case a determination is made that trouble in execution has occurred (YES in the determination in Step 425). If it is determined that the trouble in execution is serious under a predetermined standard (YES in the determination in Step 426), advancing is stopped for the sake of safety, and required inspection is carried out (Step 427). Meanwhile, if the trouble in execution is not serious, a trouble flag is set (Step 428), and the operation proceeds to Step 424 to resume excavation.

If it is determined that trouble in execution has not occurred (NO in the determination in Step 425), the trouble flag is reset (Step 429), and the operation proceeds to Step 424 to resume advancing.

Next, if the completion of one stroke is detected by the sensor (YES in the determination in Step 430), a malfunctional warning which is adapted for the stage of completion of one stroke is issued.

Namely, a determination is made as to whether or not the failure flag and/or the trouble flag is set (Step 431), and if either of the flags is set, there is a possibility of occurrence of a serious failure or serious trouble in execution during an ensuing stroke. Hence, a warning to that effect is displayed (Step 432), and the operation returns to Step 408. Meanwhile, if neither of the two flags is set (NO in the determination in Step 431), there is particularly no problem, so that the operation returns to Step 408 without displaying the aforementioned warning. It should be noted that the warning lamp 39 is made to flash for the purpose of safety during the execution of advancing.

Figure 10:
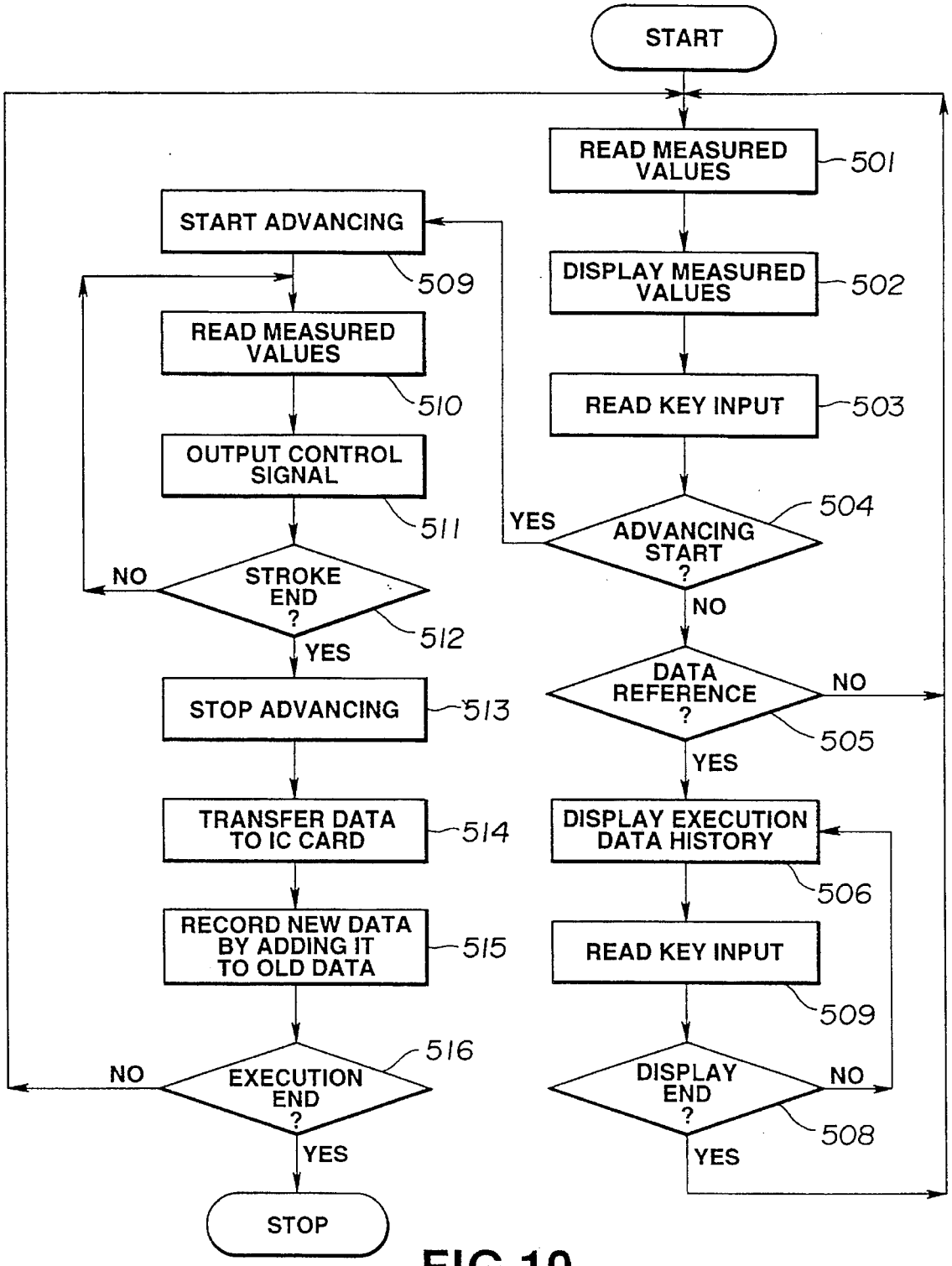
FIG. 10 is a flowchart illustrating a processing procedure of execution-data recording processing in accordance with the embodiment.

Next, referring to FIG. 10, a description will be given of processing for recording execution data in the IC card.

Namely, if the stage of executing advancing is indicated by a keying operation, processing is started, and detection signals from various sensors are inputted (Step 501), and measured values are displayed (Step 502). Then, the key input is read out (Step 503), and a determination is made as to whether or not advancing has been actually started (Step 504). If advancing has not been started, a determination is made as to whether or not data reference is to be made (Step 505). As a result, if data reference is not to be made, the operation returns to Step 501 to input detection signals.

If it is determined that data reference is to be made (YES in the determination in Step 505), the execution data is prepared, and the history of execution is displayed (Step 506). Then, key input is read out (Step 507), and a determination is made as to whether or not displaying has ended (Step 508). If the displaying has not ended, the operation returns to Step 506 to repeatedly execute the displaying of the execution data and the history. If the displaying has ended, the operation proceeds to Step 501 to conduct the inputting of detection signals again.

If it is determined in Step 504 that advancing has been started by key input, control signals are outputted to the actuators to starts advancing (Step 509). Thereafter, detection signals from the sensors are inputted during excavation (Step 510), and control signals are outputted to the actuators (Step 511). Then, execution data is prepared in the meantime on the basis of the detection signals from the sensors. Unless the stage of completion of one stroke is detected by the sensor for detecting the completion of one stroke (NO in the determination in Step 512), processing of Steps 510 and 511 is repeatedly executed. However, if the completion of one stroke is detected (YES in the determination in Step 512), the control signals for the actuators are turned off to stop advancing (Step 513).

In due course of time, the execution data prepared in the IC card 37 by means of the IC card reader/writer 38 is transferred (Step 514), and new execution data is recorded by being added to the execution data recorded up until now (Step 515). Here, advancing is stopped, and the execution data is transferred at a stage in which a re-setup is being executed. Accordingly, the actual excavation work is not affected by the transfer (the time required for it). In other words, the operating efficiency is not impaired. Moreover, since the execution data in units of one stroke is consecutively recorded, data management suitable for the excavator of a single-process type can be effected.

Then, a determination is made as to whether or not the execution has ended. If the "end of execution" is instructed by, for instance, a keying operation, processing ends. Unless the "end of execution" is instructed, the operation returns to Step 501 to repeatedly execute similar processing.

Thus, when the execution data is consecutively recorded in the IC card 37, the operator removes the IC card 37 from the IC card reader/writer 38, carries it, and sets it in the IC card reader/writer 41 in the building. Then, the operator is able to conduct analysis and the like of the record of execution in units of, for instance, one week, by means of the computer system shown in FIG. 3. It should be noted that a recording medium for recording the execution data is not confined to the IC card, and an arbitrary recording medium may be used insofar as it is portable and the contents of the record are not lost even when the power supply is turned off.

In addition, although, in the embodiments, it is assumed that a small-bore-pipe excavator is used as the excavator, the present invention is not limited to the same, and may be applied to an arbitrary underground excavator such as a tunnel-boring machine and the like.

INDUSTRIAL APPLICABILITY

As described above, in accordance with the-present invention, since the actuators are controlled by ascertaining changes in the soil condition, excavation can be carried out with a high degree of precision, and the operating efficiency improves remarkably. In addition, since a self-diagnostic check and a malfunctional warning corresponding to each stage of the operation of the excavator are conducted, such a check and the like are conducted speedily and appropriately, so that the reliability apparatus improves remarkably. Furthermore, since execution data can be automatically recorded for each stroke, the recording of the execution data can be effected without impairing the operating efficiency in the so-called excavator of a single-process type, data management suited to the excavator of a single-process type can be carried out, and the operating efficiency improves remarkably.

We claim:

1. A controlling apparatus for an excavator having an excavating cutter at a distal end thereof for excavating in the ground by rotating said cutter by means of a cutter-rotating actuator and by advancing said excavator by means of an advancing actuator, characterized by comprising:

input means for inputting a soil condition at a place where said excavator advances;

setting means for setting a reference number of revolutions of said cutter and a reference advancing speed of said excavator in correspondence with the soil condition inputted by said input means;

load-detecting means for detecting a load applied to each of said actuators;

number-of-revolutions controlling means for controlling said cutter-rotating actuator so as to obtain the reference number of revolutions set by said setting means;

speed-controlling means for controlling said advancing actuator so as to obtain the reference advancing speed set by said setting means if it is detected by said load-detecting means that the load on each of said actuators is within a predetermined range, and for controlling said advancing actuator so as to reset the reference advancing speed to a value smaller than the reference advancing speed if the load on either of said actuators reaches an upper limit, and toga value greater than the reference advancing speed if the load on either of said actuators becomes less than a lower limit.

2. A controlling apparatus for an excavator according to claim 1, wherein if it is detected by said load-detecting means that the load on said cutter-rotating actuator has exceeded a predetermined threshold value, it is determined that a rotation stall of said cutter has occurred, the advancing of said excavator and the rotation of said cutter are stopped, and predetermined processing is carried out.

3. A controlling apparatus for an excavator having a cutter head which is disposed swingably at a distal end of an excavator and is swung by a direction-correcting actuator to change an advancing direction in such a manner as to allow said excavator to advance in a targeted advancing direction, a cutter which is disposed at a distal end of said cutter head and is rotated by a cutter-rotating actuator to perform excavation, a screw for removing earth and sand excavated by said cutter in a rearward direction, and a pinch valve for changing a cross-sectional area of a passage for the earth and sand removed by said screw, so as to excavate in the ground by controlling said actuators and by controlling said pinch valve, characterized by comprising:

input means for inputting a soil condition of a place where said excavator advances;

first determining means for detecting a load on said cutter-rotating actuator and for determining on the basis of a result of said detection whether or not an amount of change of the load is equal to or greater than a predetermined threshold value;

second determining means for calculating a direction-correcting speed by means of said direction-correcting actuator, and for determining on the basis of a result of said calculation whether or not direction correction for setting the advancing direction of said excavator in said targeted advancing direction is being performed speedily;

third determining means for determining the presence or absence of execution of control of said pinch valve on the basis of the soil condition inputted by said input means;

cross-sectional-area setting means for setting a reference cross-sectional area of said passage in correspondence With the soil condition inputted by said input means if it is determined by said third determining means that control of said pinch valve is to be executed, resetting the cross-sectional area of said passage to a cross-sectional area smaller than said set reference cross-sectional area if it is determined by said first determining means that the amount of change of the load on said cutter-rotating actuator is equal to or greater than the predetermined threshold value or if it is determined by said second determining means that direction correction by said direction-correcting actuator is not being carried out speedily, and resetting the cross-sectional area of said passage to a cross-sectional area greater than said set reference cross-sectional area if it is determined by said first determining means that the amount of change of the load on said cutter-rotating actuator is less than a predetermined threshold value and if it is determined by said second determining means that direction correction by said direction-correcting actuator is being carried out speedily; and controlling means for controlling said pinch valve so as to set the cross-sectional area of said passage to the cross-sectional area set or reset by said cross-sectional-area setting means.

4. A controlling apparatus for an excavator having a cutter head which is disposed swingably at a distal end of an excavator and is swung by a direction-correcting actuator to change an advancing direction in such a manner as to allow said excavator to advance in a targeted advancing direction, a cutter which is disposed at a distal end of said cutter head and is rotated by a cutter-rotating actuator to perform excavation, a screw for removing earth and sand excavated by said cutter in a rearward direction, water-injecting means for injecting water into a passage for the earth and sand removed by said screw, and an advancing actuator for advancing said excavator, So as to excavate in the ground by controlling said actuators and by controlling injection of water by said water-injecting means, characterized by comprising:

input means for inputting a soil condition of a place where said excavator advances;

load-detecting means for detecting a rotational load applied to said cutter-rotating actuator and an advancing load applied to said advancing actuator, respectively;

determining means for determining the presence or absence of execution of control of water injection by said water-injecting means on the basis of the soil condition inputted by said input means; and controlling means for performing water injection into said passage by turning on said water-injecting means if it is determined by said determining means that water-injection control is to be executed, and if it is determined by said load-detecting means that the rotational load is equal to or greater than a predetermined threshold value and that the advancing load is equal to or less than a predetermined threshold value.

5. A controlling apparatus for an excavator having input means for inputting data for operating said excavator, sensors for detecting states of various parts of said excavator, actuators for driving the various parts of said excavator, a controller for performing predetermined processing and controlling the driving of said actuators on the basis of the data inputted by said input means and values detected by said sensors so as to operate said excavator, and display means for displaying a result of processing by said controller, wherein said excavator, said input means, said sensors, said actuators, said controller, and said display means are connected by means of wire or radio transmission, characterized in that:

if operation-stage data indicating a respective stage of operation is inputted by said input means, or if the stage of operation is detected by a predetermined one of said sensors, said controller conducts in response to each separate inputted or detected stage of operation a check of functions of said input means and each part of said controller as compared with a default value, an abnormality check of the values detected by said sensors on the basis of the values detected by said sensors, a check of states of operation of said actuators on the basis of the values detected by said sensors, or a check of a state of transmission of a signal in the wire or radio transmission, and results of said checks are displayed on said display means.

6. A controlling apparatus for an excavator according to claim 5, wherein in a case where the stage of operation is that of said excavator being operated, processing is effected for stopping the operation of said actuators in correspondence with the results of any of said individual checks.

7. A controlling apparatus for an excavator having an excavator which is advanced in units of one stroke and in which a predetermined re-setup is effected after completion of each stroke, sensors for detecting states of various parts of said excavator, an actuator for advancing said excavator in units of one stroke, input means for inputting data for operating said excavator, a controller for performing predetermined processing and controlling the driving of said actuator on the basis of the data inputted by said input means and values detected by said sensors so as to operate said excavator, and a storage medium for storing results of processing by said controller, characterized in that:

there is provided detecting means for detecting that said excavator has advanced by one stroke; and that said controller prepares execution data on the basis of the values detected by said sensors, and each time the advance of said excavator by one stroke is detected by said detecting means, said controller turns off said actuator and effects processing in which the data on execution during the advance by one stroke is written in said storage medium.

8. A controlling apparatus for an excavator according to claim 7, wherein said storage medium is an IC card.

* * * * *